US007232047B2

(12) United States Patent
Greer, Jr. et al.

(10) Patent No.: US 7,232,047 B2
(45) **Date of Patent: *Jun. 19, 2007**

(54) STORAGE SYSTEMS AND METHODS FOR AEROSOL ACCESSORIES

(75) Inventors: Lester R. Greer, Jr., Bellingham, WA (US); James A. Tryon, Seattle, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/170,618

(22) Filed: Jun. 28, 2005

(65) Prior Publication Data

US 2005/0258198 A1 Nov. 24, 2005

Related U.S. Application Data

(63) Continuation of application No. 10/293,116, filed on Nov. 12, 2002, now Pat. No. 6,910,608.

(51) Int. Cl.
*B67D 3/00* (2006.01)

(52) U.S. Cl. ..... 222/538; 222/402.1

(58) Field of Classification Search ..... 222/538, 222/530, 153.06, 153.11, 402.1, 153.01, 153.05, 222/527; 239/237
See application file for complete search history.

(56) References Cited

U.S. PATENT DOCUMENTS 568,876 A 10/1896 Regan
2,388,093 A 10/1945 Smith
2,785,926 A 3/1957 Lataste
2,908,446 A 10/1959 Strouse
2,968,441 A 1/1961 Holcomb
3,083,872 A 4/1963 Meshberg
3,191,809 A 6/1965 Schultz et al.
3,216,628 A 11/1965 Fergusson
3,246,850 A 4/1966 Bourke
3,258,208 A 6/1966 Greenbaum, II
3,342,382 A 9/1967 Huling
3,346,195 A 10/1967 Groth
3,377,028 A 4/1968 Bruggeman
3,414,171 A 12/1968 Grisham et al.
3,415,351 A 12/1968 Otto et al.

(Continued)

FOREIGN PATENT DOCUMENTS

DE 210449 5/1909

(Continued)

*Primary Examiner*—Lien M. Ngo
(74) *Attorney, Agent, or Firm*—Michael R. Schacht; Schacht Law Office, Inc.

(57) ABSTRACT

An aerosol system for dispensing liquid material. An aerosol system for dispensing material, comprising an aerosol assembly, a cover member, a plurality of dispensing tubes, and an accessory storage system. The aerosol assembly defines a cap member and an actuator member. Each dispensing tube is associated with a predetermined pattern. Each of the dispensing tubes may be in a first configuration in which the dispensing tube is secured relative to the actuator member of the aerosol assembly and a second configuration in which the dispensing tubes is secured relative to the aerosol assembly by the accessory storage system. When the cover member covers the actuator member and the dispensing tubes are in the second configuration, the cap member further covers the accessory storage system and the dispensing tubes.

7 Claims, 4 Drawing Sheets

U.S. PATENT DOCUMENTS

| | | | |
|---|---|---|---|
| 3,428,224 | A | 2/1969 | Eberhardt et al. |
| 3,472,457 | A | 10/1969 | McAvoy |
| 3,698,645 | A | 10/1972 | Coffey |
| 3,703,994 | A | 11/1972 | Nigro |
| 3,795,366 | A | 3/1974 | McGhie et al. |
| 3,891,128 | A | 6/1975 | Smrt |
| 3,912,132 | A | 10/1975 | Stevens |
| 3,913,842 | A | 10/1975 | Singer |
| 3,945,571 | A | 3/1976 | Rash |
| 4,096,974 | A | 6/1978 | Haber et al. |
| 4,123,005 | A | 10/1978 | Blunk |
| 4,187,985 | A | 2/1980 | Goth |
| 4,364,521 | A | 12/1982 | Stankowitz |
| 4,401,271 | A | 8/1983 | Hansen |
| 4,401,272 | A | 8/1983 | Merton et al. |
| 4,411,387 | A | 10/1983 | Stern et al. |
| 4,728,007 | A | 3/1988 | Samuelson et al. |
| 4,819,838 | A | 4/1989 | Hart, Jr. |
| 4,893,730 | A | 1/1990 | Bolduc |
| 4,955,545 | A | 9/1990 | Stern et al. |
| 4,961,537 | A | 10/1990 | Stern |
| 4,969,579 | A | 11/1990 | Behar |
| 4,988,017 | A | 1/1991 | Schrader et al. |
| 4,991,750 | A | 2/1991 | Moral |
| 5,037,011 | A | 8/1991 | Woods |
| 5,052,585 | A | 10/1991 | Bolduc |
| 5,069,390 | A | 12/1991 | Stern et al. |
| 5,100,055 | A | 3/1992 | Rokitenetz et al. |
| 5,188,263 | A | 2/1993 | Woods |
| 5,188,295 | A | 2/1993 | Stern et al. |
| 5,232,161 | A | 8/1993 | Clemmons |
| 5,297,704 | A | 3/1994 | Stollmeyer |
| 5,307,964 | A | 5/1994 | Toth |
| 5,310,095 | A | 5/1994 | Stern et al. |
| 5,341,970 | A | 8/1994 | Woods |
| 5,405,051 | A | 4/1995 | Miskell |
| 5,409,148 | A | 4/1995 | Stern et al. |
| D358,989 | S | 6/1995 | Woods |
| 5,421,519 | A | 6/1995 | Woods |
| 5,450,983 | A | 9/1995 | Stern et al. |
| 5,476,879 | A | 12/1995 | Woods et al. |
| 5,489,048 | A | 2/1996 | Stern |
| 5,505,344 | A | 4/1996 | Woods |
| 5,524,798 | A | 6/1996 | Stern et al. |
| 5,544,783 | A | 8/1996 | Conigliaro |
| 5,558,247 | A | 9/1996 | Caso |
| 5,645,198 | A | 7/1997 | Stern et al. |
| 5,655,691 | A | 8/1997 | Stern et al. |
| 5,715,975 | A | 2/1998 | Stern et al. |
| 5,934,518 | A | 8/1999 | Stern et al. |
| 5,988,575 | A | 11/1999 | Lesko |
| 6,000,583 | A | 12/1999 | Stern et al. |
| 6,315,152 | B1 | 11/2001 | Kalisz |
| 6,328,185 | B1 | 12/2001 | Stern et al. |

FOREIGN PATENT DOCUMENTS

| | | |
|---|---|---|
| DE | 1926796 | 3/1970 |
| FR | 1586067 | 2/1970 |
| GB | 867713 | 5/1961 |
| GB | 1144385 | 3/1969 |
| JP | 1392/71 | 12/1966 |

STORAGE SYSTEMS AND METHODS FOR AEROSOL ACCESSORIES

RELATED APPLICATIONS

This is a continuation of U.S. patent application Ser. No. 10/293,116, filed Nov. 12, 2002, now U.S. Pat. No. 6,910, 608 the contents of which are incorporated herein by reference.

TECHNICAL FIELD

The present invention relates to aerosol systems and, more particularly, to systems and methods for storing accessories used with aerosol systems.

BACKGROUND OF THE INVENTION

The present invention relates to aerosol systems comprising an aerosol assembly and a liquid product to be dispensed. The aerosol assembly conventionally comprises a container, a valve assembly, an actuator assembly, and a cap. The liquid product is disposed within the container along with a propellant material that pressurizes the product. The valve assembly is normally in a closed configuration but may be placed in an open configuration to allow pressurized product to exit the container. The actuator assembly engages the valve assembly such that pressing the actuator assembly places the valve assembly in the open configuration to allow the product to be dispensed through a nozzle formed by the actuator assembly. The cap engages the container to protect the actuator assembly when the aerosol system is not in use.

For some materials dispensed using an aerosol system, accessories are used in connection with the material being dispensed and/or the aerosol system. Accessories may include dispensing tubes or straws, brushes, cleaning devices, or any other small tool or adapter used to work the material or which is attached to the aerosol assembly as the material is dispensed.

The present invention is of particular significance when used to store dispensing tubes used with an aerosol system for dispensing texture material, and that application will be described herein in detail. The present invention may be used in other environments, however, and the scope of the present invention should be determined by the claims appended hereto and not the following detailed description.

For aesthetic reasons, texture material is often applied to wall surfaces. Texture material creates a bumpy or variegated pattern on the wall surface. Such texture patterns are often referred to as fine, medium, orangepeel, or the like. When a wall surface must be patched in a relatively small area, often the most convenient method of applying texture material is with an aerosol system. Dispensing the texture material through dispensing tubes with different internal bore diameters allows the texture material to be dispensed in different texture patterns. One of the dispensing tubes is selected such that the texture pattern obtained substantially matches the pre-existing texture pattern.

Conventionally, the dispensing tubes are taped to the aerosol container during manufacture. Such straws may be misplaced and/or stolen during shipping and retail display. Additionally, after the aerosol system is used for the first time, the user must take care to ensure that the straws are stored for the next and any subsequent use of the aerosol system. The need thus exists for improved systems and methods for storing accessories, including but not limited to dispensing tubes, for aerosol systems during shipping, retail display, and storage before and after the first use.

SUMMARY OF THE INVENTION

The present invention is typically embodied in the form of an aerosol system for dispensing liquid material comprising an aerosol assembly, a cover member, a plurality of dispensing tubes, and an accessory storage system. The aerosol assembly defines a cap member and an actuator member. Each dispensing tube is associated with a predetermined texture pattern. Each of the dispensing tubes may be in a first configuration in which the dispensing tube is secured relative to the actuator member of the aerosol assembly and a second configuration in which the dispensing tubes is secured relative to the aerosol assembly by the accessory storage system. When the cover member covers the actuator member and the dispensing tubes are in the second configuration, the cap member further covers the accessory storage system and the dispensing tubes.

DETAILED DESCRIPTION OF THE INVENTION

1. First Embodiment

Figure 1:
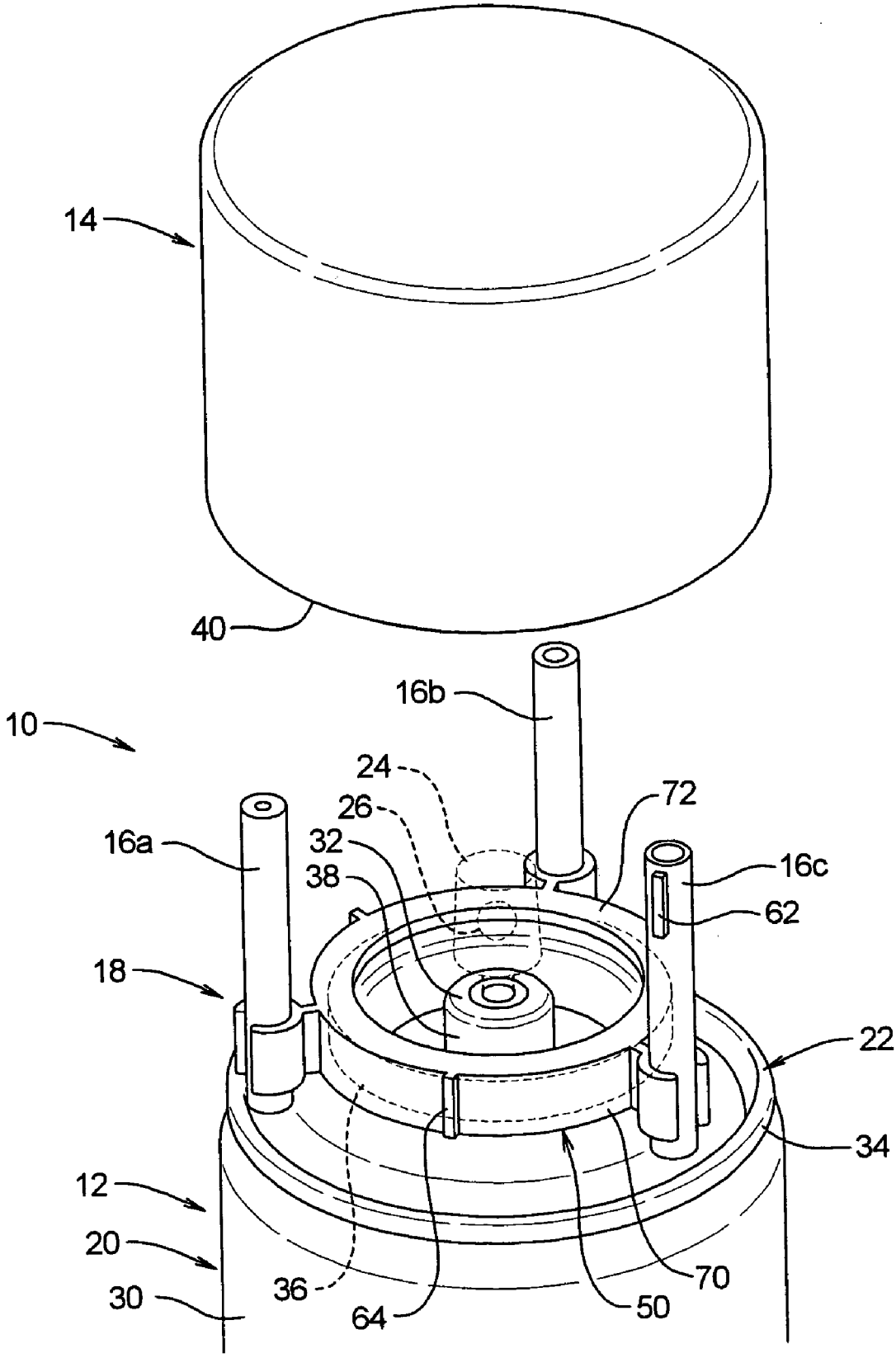
FIG. 1 is an exploded perspective view of portion of a first embodiment of an aerosol system constructed in accordance with the principles of the present invention.

Depicted at 10 in FIG. 1 is a first embodiment of an aerosol dispensing system constructed in accordance with, and embodying, the principles of the present invention. The exemplary aerosol dispensing system 10 comprises an aerosol assembly 12, a cover member 14, one or more accessory members 16, and an accessory storage system 18.

In the exemplary system 10, the aerosol assembly 12 comprises a container member 20, a cap member 22, and an actuator member 24. As is conventional, the cap member 22 is secured to the container member 20. A valve assembly (not shown) is mounted within the container member 20, and the actuator member 24 extends through the cap member 22 to engage the valve assembly. Depressing the actuator member 24 causes a propellant (not shown) to force texture material (also not shown) out of the aerosol assembly 12 through an actuator opening 26 in the actuator member 24.

The exemplary accessory members 16 are dispensing tubes or straws having the same outer diameter and defining bores having different inner diameters. As generally discussed above, accessory members 16 other than dispensing tubes or straws may be used to implement the principles of the present invention in a broader form.

With the exemplary dispensing system 10 for dispensing texture material, the outer diameters of the members 16 are sized and dimensioned to be snugly received within the actuator opening 26. The texture material thus flows out of the bore defined by the exemplary accessory member 16 that is received by the actuator opening 26. Accordingly, a selected one of the members 16 is engaged with the actuator opening 26 to dispensing the texture material in selected texture pattern.

The container member 20 defines a container outer surface 30. The cap member 22 defines a valve housing 32 and first and/or second surfaces 34 and 36. The valve housing 32 defines a valve housing outer surface 38. As is conventional, the exemplary container outer surface 30, first and second surfaces 34 and 36, and valve housing outer surface 38 are all cylindrical and have common longitudinal axes. Other physical arrangements are possible, but the described arrangement is conventional.

The cover member 14 defines a cover member lower edge 40. In the exemplary first embodiment, this lower edge 40 engages the first surface 34 to secure the cover member 14 relative to the container member 20.

The exemplary accessory storage system 18 comprises an aerosol engaging portion 50, one or more accessory retaining portions 52, and one or more accessory support bridges 54. The aerosol engaging portion 50 is sized and dimensioned to engage one or both of the container member 20 and the cap member 22 to secure the storage system 18 relative to the container member 20. The exemplary aerosol engaging portion 50 is adapted to engage the second annular surface 36 formed on the cap member 22.

The retaining portions 52 are each adapted to detachably attach one of the accessory members 16 relative to the aerosol engaging portion 50. The support bridges 54 are adapted to attach one of the accessory members 16 to the aerosol engaging portion 50 one time. As will be explained in further detail below, the bridges 54 are broken to detach the accessory member 16 associated therewith from the aerosol engaging portion 50.

The principles of the present invention may be embodied in an accessory storage system employing only one retaining portion 52, only one accessory support bridge 54, one retaining portion 52 and one accessory support bridge 54, one retaining portion 52 and a plurality of accessory support bridges 54, a plurality of the retaining portions 52 and one accessory support bridge 54, or, as in the exemplary accessory storage system 18, a plurality of retaining portions 52 and a plurality of the accessory support bridges 54.

Figure 2:
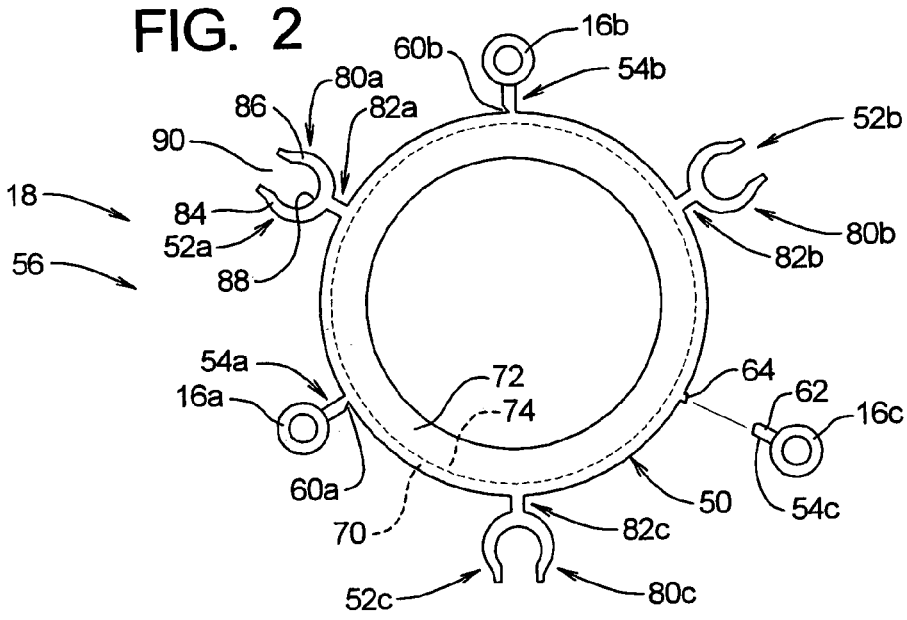
FIG. 2 is a top plan view of the accessory storage system of the aerosol system of FIG. 1.

In the exemplary accessory storage system 18, the system 18 is manufactured by injection molding the aerosol engaging portion 50, retaining portions 52, accessory support bridges 54, and accessory members 16 as a single part 56 as generally shown in FIG. 2. A bridge relief portion 60 is formed in each of the accessory support bridges 54; the relief portions 60 are essentially thinned portions of the bridges 54 that allow the bridges 54 to be broken into first and second bridge portions 62 and 64 as will be described in further detail below.

After the part 56 is manufactured and the aerosol assembly 12 is filled with the propellant and texture material, the part 56 is arranged such that the aerosol engaging portion 50 engages the second surface 36 to secure the part 56 relative to the assembly 12. In particular, the exemplary aerosol engaging portion 50 comprises an engaging wall 70 and a top wall 72. The exemplary second surface 36 is generally cylindrical as described above, so the engaging surface 74 is also generally cylindrical. Again, other geometries may be used, but the use of cylindrical surfaces is conventional.

The engaging wall defines an engaging surface 74 adapted to form a friction fit with the second surface 36 that prevents the part 56 from becoming inadvertently removed from the aerosol assembly 12 under normal conditions. However, the part 56 may be placed onto or removed from the container 20 of the aerosol system 12 by deliberate application of manual force.

With the part 56 intact and engaged with the surface 36, the system 20 is in what will be referred to as the shipping and display configuration. In this shipping and display configuration, the system 10 will be shipped and displayed at the retail level.

Immediately prior to use, one or more of the accessory members 16 is removed from the aerosol engaging portion 50 of the accessory storage system 18 by breaking the accessory support bridge or bridges 54 at the relief portion or portions 60. The accessory member or members 16 can then be used as desired in conjunction with the aerosol assembly 12. The system 10 is in what will be referred to as the use configuration at this point.

After the initial use, the accessory member or members 16 removed from the aerosol engaging portion 50 can be reattached to the aerosol engaging portion 50 using the accessory retaining portions 52. At this point, the system 10 is in what will be referred to as a storage configuration. When the system 10 is in the storage configuration, the storage system 18 ensures that the accessory members 16 will not become separated from the aerosol assembly 12 and will be available for the next use.

The exemplary accessory retaining portions 52 can be formed of any physical structure capable of securing the accessory members 16 to the aerosol engaging portion 50. The exemplary accessory retaining portions 52 are formed by accessory clips 80 comprising a standoff portion 82 and first and second clip arms 84 and 86. The clip arms 84 and 86 define a clip surface 88 and a clip opening 90. The clip surface 88 and clip opening 90 are sized and dimensioned to receive the outer surfaces of the accessory members 16. In particular, the clip opening 90 is slightly smaller than the outer diameter of the accessory members 16, but the clip arms 84 and 86 are flexible and deform slightly to allow the clip 80 pass through the opening 90. The clip arms 84 and 86 thus prevent inadvertent movement of the members 16 relative to the aerosol engaging portion 50, but the members 16 can be detached from the clips 90 by deliberate application of manual force.

2. Second Embodiment

Figure 3:
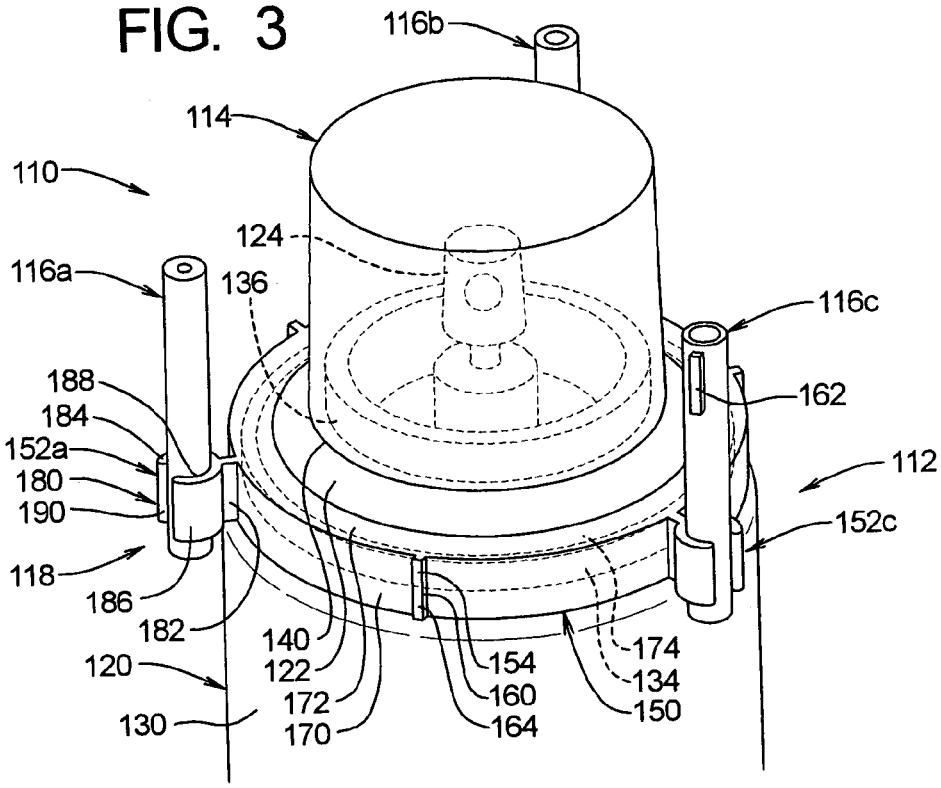
FIG. 3 is a perspective view of portion of a second embodiment of an aerosol system constructed in accordance with the principles of the present invention.

Depicted at 110 in FIG. 3 is a second embodiment of an aerosol dispensing system constructed in accordance with, and embodying, the principles of the present invention. The exemplary aerosol dispensing system 110 comprises an aerosol assembly 112, a cover member 114, one or more accessory members 116, and an accessory storage system 118.

The aerosol assembly 112 of the system 110 comprises a container member 120, a cap member 122, and an actuator member 124. The aerosol assembly 112 is or may be conventional and will not be describe herein in further detail.

As in the system 10 described above, the exemplary accessory members 116 are dispensing tubes or straws having the same outer diameter and defining bores having different inner diameters. However, accessory members 116 other than dispensing tubes or straws may be used to implement the principles of the present invention in a broader form.

The container member 120 defines a container outer surface 130. The exemplary cap member 122 defines first and/or second surfaces 134 and 136. As is conventional, the exemplary container outer surface 130 and first and second surfaces 134 and 136 are all cylindrical and have common longitudinal axes. Other physical arrangements are possible, but the described arrangement is conventional.

The cover member 114 defines a cover member lower edge 140. In contrast to the exemplary first embodiment described above, the lower edge 140 of the second embodiment engages the second surface 136 to secure the cover member 114 relative to the container member 120.

The exemplary accessory storage system 118 comprises an aerosol engaging portion 150, one or more accessory retaining portions 152, and one or more accessory support bridges 154. The aerosol engaging portion 150 is sized and dimensioned to engage one or both of the container member 120 and the cap member 122 to secure the storage system 118 relative to the container member 120. The exemplary aerosol engaging portion 150 is adapted to engage the first annular surface 134 formed on the cap member 122.

The retaining portions 152 are each adapted to detachably attach one of the accessory members 116 relative to the aerosol engaging portion 150. The support bridges 154 are adapted to attach one of the accessory members 116 to the aerosol engaging portion 150 one time. As with the bridges 54 described above, the bridges 154 are broken to detach the accessory member 116 associated therewith from the aerosol engaging portion 150.

In the exemplary accessory storage system 118, the system 118 is manufactured by injection molding the aerosol engaging portion 150, retaining portions 152, accessory support bridges 154, and accessory members 116 as a single part similar to the part 56 described above. A bridge relief portion 160 is formed in each of the accessory support bridges 154; the relief portions 160 are essentially thinned portions of the bridges 154 that allow the bridges 154 to be broken into first and second bridge portions 162 and 164.

After the part is manufactured and the aerosol assembly 112 is filled with the propellant and texture material, the part 156 is arranged such that the aerosol engaging portion 150 engages the second surface 136 to secure the part 156 relative to the assembly 112. In particular, the exemplary aerosol engaging portion 150 comprises an engaging wall 170 and a top wall 172. The engaging wall defines an engaging surface 174 adapted to form a friction fit with the second surface 136 that prevents the part 156 from becoming inadvertently removed from the aerosol assembly 112.

Immediately prior to use, one or more of the accessory members 116 is removed from the aerosol engaging portion 150 of the accessory storage system 118 by breaking the accessory support bridge or bridges 154 at the relief portion or portions 160. The accessory member or members 116 can then be used as desired in conjunction with the aerosol assembly 112.

After the initial use, the accessory member or members 116 removed from the aerosol engaging portion 150 can be reattached to the aerosol engaging portion 150 using the accessory retaining portions 152.

The exemplary accessory retaining portions 152 can be formed of any physical structure capable of securing the accessory members 116 to the aerosol engaging portion 150. The exemplary accessory retaining portions 152 are formed by accessory clips 180 comprising a standoff portion 182 and first and second clip arms 184 and 186. The clip arms 184 and 186 define a clip surface 188 and a clip opening 190. The clip surface 188 and clip opening 190 are sized and dimensioned to receive the outer surfaces of the accessory members 116. In particular, the clip opening 190 is slightly smaller than the outer diameter of the accessory members 116, but the clip arms 184 and 186 are flexible and deform slightly to allow the clip 180 pass through the opening 190. The clip arms 184 and 186 thus prevent inadvertent movement of the members 116 relative to the aerosol engaging portion 150, but the members 116 can be detached from the clips 180 by deliberate application of manual force.

The system 110 thus operates in shipping and display, use, and storage configurations similar to the system 10 described above.

3. Third Embodiment

Figure 4:
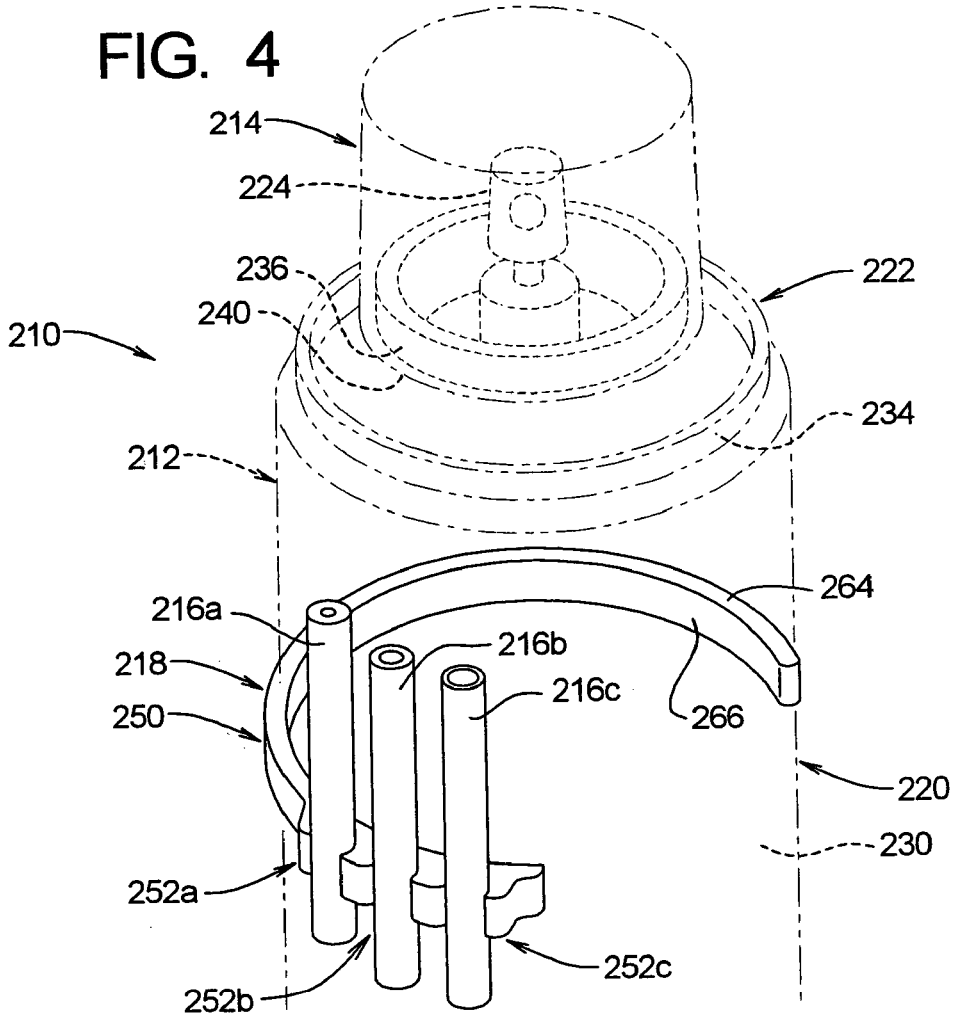
FIG. 4 is a perspective view of portion of a third embodiment of an aerosol system constructed in accordance with the principles of the present invention.
Figure 5:
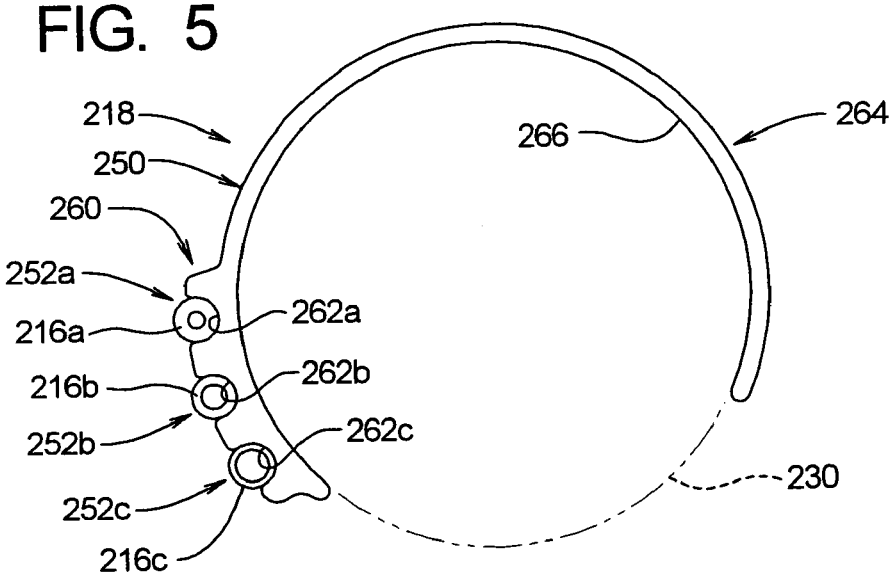
FIG. 5 is a top plan view of the accessory storage system of the aerosol system of FIG. 4.
Figure 6:
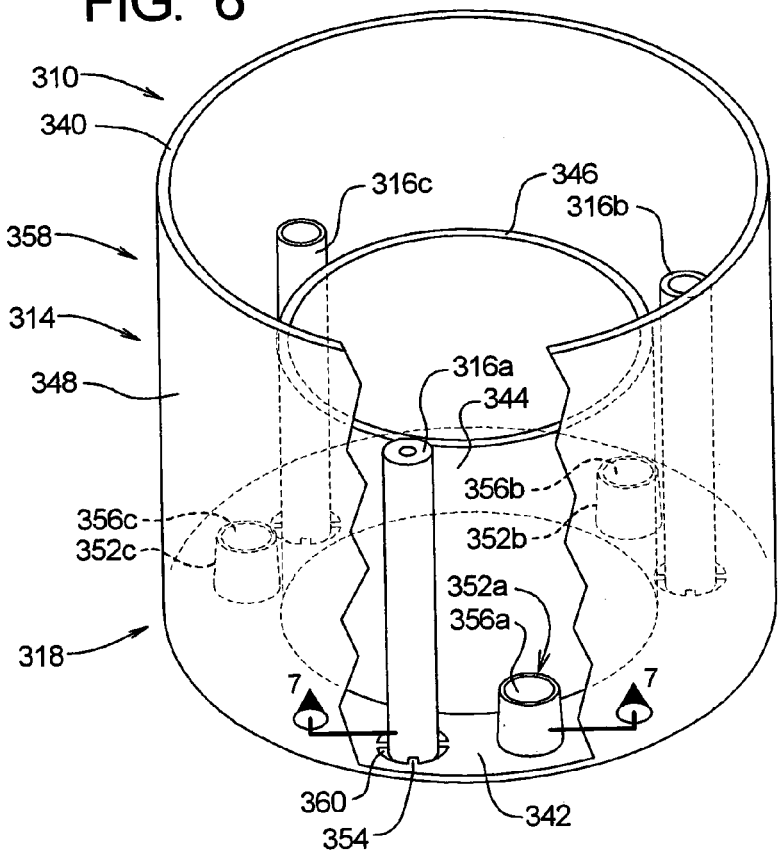
FIG. 6 is a perspective view of portion of an accessory storage system of a fourth embodiment of the present invention.
Figure 7:
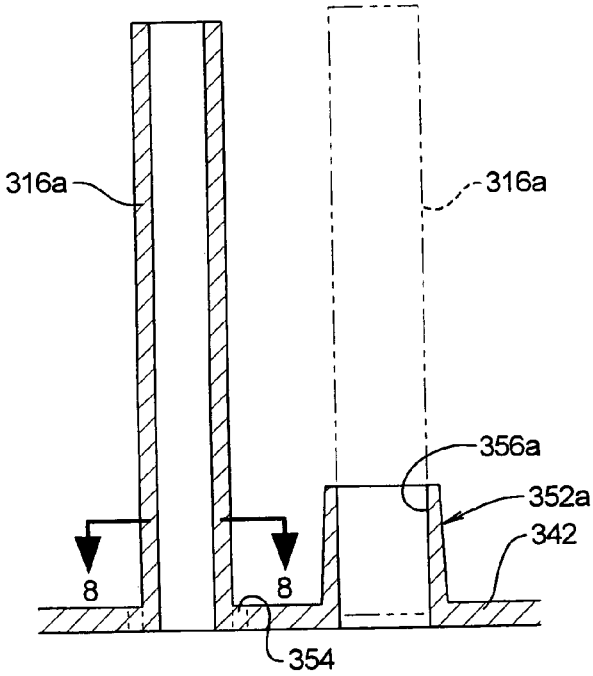
FIG. 7 is a side elevation cutaway view of a portion of the accessory storage system of FIG. 6.

Depicted at 210 in FIGS. 4 and 5 is a third embodiment of an aerosol dispensing system constructed in accordance with, and embodying, the principles of the present invention. The exemplary aerosol dispensing system 210 comprises an aerosol assembly 212, a cover member 214, one or more accessory members 216, and an accessory storage system 218.

The aerosol assembly 212 of the system 210 comprises a container member 220, a cap member 222, and an actuator member 224. The aerosol assembly 212 is or may be conventional and will not be described herein in further detail.

As in the systems 10 and 110 described above, the exemplary accessory members 216 are dispensing tubes or straws having the same outer diameter and defining bores having different inner diameters. However, accessory members 216 other than dispensing tubes or straws may be used to implement the principles of the present invention in a broader form.

The container member 220 defines a container outer surface 230. The exemplary cap member 222 defines first and/or second surfaces 234 and 236. As is conventional, the exemplary container outer surface 230 and first and second surfaces 234 and 236 are all cylindrical and have common longitudinal axes. Other physical arrangements are possible, but the described arrangement is conventional.

The cover member 214 defines a cover member lower edge 240. As with the exemplary first embodiment described above, the lower edge 240 of the second embodiment engages the first surface 234 to secure the cover member 214 relative to the container member 220.

The exemplary accessory storage system 218 comprises an aerosol engaging portion 250 and one or more accessory retaining portions 252. The aerosol engaging portion 250 is sized and dimensioned to engage one or both of the container member 220 and the cap member 222 to secure the storage system 218 relative to the container member 220. The exemplary aerosol engaging portion 250 is adapted to engage the outer surface 230 formed by the container member 220.

The retaining portions 252 are each adapted to detachably attach one of the accessory members 216 relative to the aerosol engaging portion 250.

In the exemplary accessory aerosol system 210, the accessory members 216 are manufactured separately from the accessory storage system 218. Optionally, the accessory members 16 and 116 may be similarly manufactured separately from the storage systems 18 and 118 thereof.

After the aerosol assembly 212 is filled with the propellant and texture material, the aerosol engaging portion 250 is engaged with the container surface 230 to secure the system 218 relative to the assembly 212. The accessory members 216 are then detachably attached to storage system 218.

In particular, the exemplary aerosol engaging portion 250 comprises an accessory projection 260 defining one or more accessory surfaces 262. The exemplary accessory surfaces 262 are generally C-shaped and are sized and dimensioned to each receive an accessory member 216. When the accessory members 216 are received by the accessory surfaces 262, the accessory members 216 forms a snap fit that secures the accessory members 216 to the aerosol engaging portion 250 under normal use. However, the accessory members 216 may be removed from the accessory projection 260 by the deliberate application of manual force.

The accessory projection 260 extends from an engaging ring 264. The engaging ring 264 defines an engaging surface 266. The engaging ring 264 extends around at least half of the circumference of the container 220. The engaging ring 264 resiliently deforms to allow the storage system 218 to be placed around the container 220. After the storage system 218 is arranged around the container 220, the engaging ring 264 tends to return to its original form, thereby enhancing frictional engagement of the engaging surface 266 and the container surface 230. The engaging ring 264 thus maintains the storage system 218 on the container 220 under normal conditions but may be placed onto or removed from the container 220 by deliberate application of manual force.

One accessory member 216 is detached from the storage system 218 to place the system 210 in a use configuration, and the system 210 is in a storage configuration when the accessory member or members 216 are received by the accessory retaining portions 254. The system 210 thus is capable of operating in use and storage configurations similar to the same configurations of the systems 10 and 110 described above. The system 210 does not, however, have shipping and display configuration comparable to that configuration of the system 10 and 110; instead, the system 210 is shipped and displayed for retail sale in the storage configuration.

4. Fourth Embodiment

Referring now to FIGS. 6–9, depicted therein is a part of an aerosol system 310; in particular, FIGS. 6–9 illustrate a cap member 314, accessory members 316, and an accessory storage system 318 of a fourth embodiment of an aerosol system 310 of the present invention. The aerosol assembly 310 may be any conventional aerosol assembly including any one of the aerosol assemblies 12, 112, and 312 described above. The construction and operation of the aerosol assembly 310 will not be described in further detail herein.

As with the systems 10, 110, and 210 described above, the exemplary accessory members 316 are dispensing tubes or straws having the same outer diameter and defining bores having different inner diameters. However, accessory members 316 other than dispensing tubes or straws may be used to implement the principles of the present invention in a broader form.

The cover member 314 defines a cover member lower edge 340. The cover member lower edge 340

The accessory storage system 318 extends from the cover member 314. The exemplary storage system 318 is associated with the cover member 314. In particular, the cap member 314 comprises a cover member top wall 342, a cover member inner wall 344 defining a cover member inner edge 346, and a cover member outer wall 348 defining the cover member lower edge 340. At least one of the cover member lower edge 340 and cover member inner edge 346 is sized and dimensioned to engage an appropriate surface of the aerosol assembly to secure the cover member 314 relative to the aerosol assembly. For example, the cover member lower and inner edges 340 and 346 and are sized and dimensioned to engage the first and second surfaces 34 and 36 of the exemplary aerosol assembly 12 described above.

The storage system 318 comprises one or more accessory retaining portions 352 and one or more accessory support bridges 354. In the exemplary system 318, the retaining portions 352 are projections extending from the cover member top wall 342 that define retaining surfaces 356. In the exemplary system 318, the retaining portions extend from an inner surface of the cover member top wall 342. The retaining surfaces 356 are sized and dimensioned to receive a portion of the accessory members 316.

In the exemplary fourth embodiment, the accessory members 316 are hollow cylindrical tubes, the retaining surfaces 356 are thus cylindrical and the diameters thereof are substantially the same, or slightly smaller, than the outer diameter of the accessory members 316, although other geometries and sizes may be used. As shown by broken lines in FIG. 7, a friction fit is thus formed between outer surface portions of the accessory members 316 and the retaining surfaces 356.

The accessory retaining portions 352 of the storage system 318 thus receive and engage the accessory members 316 in a manner that allows the accessory members 316 to be attached to and detached from the cover member 314 with deliberate application of manual force. However, the storage system 318 prevents the accessory members 316 from being inadvertently removed from the cover member 314 under normal use.

In the fourth preferred embodiment, the cover member 314, accessory members 316, and storage system 318 are manufactured as a single part 358. The exemplary part 358 is optimized for the injection molding process, but other physical configurations and manufacturing techniques may be used.

The exemplary accessory support bridges 354 are formed during manufacture between the cover member top wall 342 and the accessory members 316. In the exemplary system 318, four support bridges extend between each of the accessory members 316 and the top wall 342, but one, two, or more of the bridges 354 may be used in different embodiments of the present invention.

Figure 8:
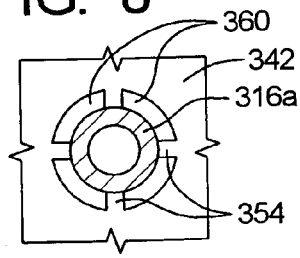
FIGS. 8 and 9 are top plan views of a portion of the accessory storage system of the aerosol system of FIG. 6.

Relief portions 360 are formed for each of the support bridges 354. The exemplary relief portions 360 lessen the amount of material that connects the accessory members 316 to the top wall 342 and thus serve a function similar to that of the relief portions 60 described above. In particular, as shown in FIG. 8, the exemplary storage system employs four support bridges 354 and four relief portions 360. The exemplary relief portions 360 are holes formed in the top wall 342 such that the only the material forming the bridges 354 connects accessory members 316 to cap member top wall 342.

Figure 9:
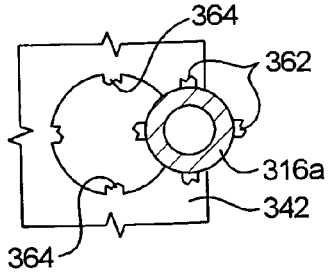

As shown in FIG. 9, the support bridges 354 may thus be broken to remove the accessory members 316 from the cover member top wall 342. After the bridges 354 are so broken, first and second bridge portions 362 and 364 remain connected to the accessory member 16 and top wall 342, respectively.

After the support bridges 354 are broken, the accessory members 316 are reattached to the cover member top wall 342 using the accessory retaining portions 352 as described above.

In the exemplary accessory storage system 18, the system 18 is manufactured by injection molding the aerosol engaging portion 50, retaining portions 52, accessory support bridges 54, and accessory members 16 as a single part 56 as generally shown in FIG. 2. A bridge relief portion 60 is formed in each of the accessory support bridges 54; the relief portions 60 are essentially thinned portions of the bridges 54 that allow the bridges 54 to be broken into first and second bridge portions 62 and 64.

With the support bridges 354 intact, the system 310 is in a shipping and display configuration. Breaking the support bridges 354 to detach one or more of the accessory members 316 from the storage system 318 allows the aerosol system 310 to be placed in a use configuration. By reattaching one or more of the accessory members 316 to the cover member 314 using the accessory retaining portions 352, the system may be placed in a storage configuration.

The system 310 thus is capable of operating in shipping and display, use, and storage configurations similar to the systems 10 and 110 described above.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. An aerosol system, comprising:

an aerosol assembly for containing and dispensing material, the aerosol assembly defining a cap member and an actuator member;

a cover member that engages the aerosol assembly to cover the actuator member;

a plurality of dispensing tubes, where each dispensing tube is associated with a predetermined pattern;

an accessory storage system to which the dispensing tubes may be detachably attached using the deliberate application of manual force, where the accessory storage system comprises an engaging portion for engaging the aerosol assembly and at least one retaining portion, and each of the dispensing tubes may be in a first configuration in which one of the dispensing tubes is secured relative to the actuator member of the aerosol assembly;

a second configuration in which at least one of the dispensing tubes is detachably attached to the accessory storage system by a retaining portion to secure the dispensing tubes relative to the aerosol assembly, and a third configuration in which at least one of the dispensing tubes is integrally formed as a single part with the accessory storage system; whereby the dispensing tubes may be reconfigured from the third configuration to one of the second and third configurations by detaching the dispensing tube from the accessory storage system by deliberate application of manual force;

when the cover member covers the actuator member and the dispensing tubes are in the second configuration, the cover member further covers the accessory storage system and the dispensing tubes; and the material is dispensed through a selected one of the dispensing tubes in its first configuration, where the material is dispensed in a predetermined pattern associated with the selected one of the dispensing tubes.

2. The aerosol system as recited in claim 1, in which the accessory storage system further comprises:

an accessory support bridge extending between the dispensing tubes and the accessory storage system to secure the dispensing tubes relative to the aerosol system in the third configuration; wherein the dispensing tubes are not secured relative to the aerosol assembly using either the accessory retaining portion or the accessory support bridge when the aerosol system is in the first configuration;

the at least one dispensing tube is secured relative to the aerosol assembly using the accessory retaining portion when the aerosol system is in the second configuration; and the accessory support bridge is broken by deliberate application of manual force to reconfigure the aerosol system from the third configuration to the first configuration.

3. The aerosol system as recited in claim 1, in which the accessory storage system comprises the accessory retaining portion that is secured relative to the aerosol assembly, where the accessory retaining portion engages the dispensing tubes when the dispensing tubes are in the second configuration.

4. An aerosol system as recited in claim 1, in which the accessory storage system defines an engaging surface that frictionally engages a portion of the cap member to secure the accessory storage system relative to the aerosol assembly.

5. The aerosol system as recited in claim 1, in which the accessory storage system comprises:

the engaging portion is adapted to securely engage a surface portion of the cap member;

at least one accessory support bridge extending between the at least one dispensing tube and the engaging portion; and a relief portion for facilitating the breaking of the at least one accessory bridge portion to remove the at least one dispensing tube from the engaging portion.

6. The aerosol system as recited in claim 1, in which the dispensing tubes comprise a plurality of dispensing tubes each defining an outlet having a different cross-sectional area.

7. An aerosol system for dispensing texture material, comprising:

an aerosol assembly for containing and dispensing texture material, the aerosol assembly defining a cap member and an actuator member;

a cover member that engages the aerosol assembly to cover the actuator member;

a plurality of dispensing tubes, where each dispensing tube is associated with a predetermined texture pattern;

an accessory storage system to which the dispensing tubes may be detachably attached using the deliberate application of manual force, where each of the dispensing tubes may be in a first configuration in which the dispensing tube is secured relative to the actuator member of the aerosol assembly;

a second configuration in which at least one of the dispensing tubes is secured relative to the aerosol assembly by the accessory storage system; and a third configuration in which the dispensing tube is integrally formed with the accessory storage system, where the accessory storage system comprises an accessory support bridge extending between the dispensing tubes and the accessory storage system to secure the dispensing tubes relative to the aerosol system in the third configuration; whereby where the dispensing tubes may be reconfigured from the third configuration to one of the second and third configurations by detaching the dispensing tube from the accessory storage system by deliberate application of manual force;

when the cover member covers the actuator member and the dispensing tubes are in the second configuration, the cover member further covers the accessory storage system and the dispensing tubes;

the texture material is dispensed through a selected one of the dispensing tubes in its first configuration, where the predetermined texture pattern associated with the selected one of the dispensing tubes forms a desired texture pattern;

the dispensing tubes are not secured relative to the aerosol assembly using either the accessory retaining portion or the accessory support bridge when the aerosol system is in the first configuration;

the at least one dispensing tube is secured relative to the aerosol assembly using the accessory retaining portion when the aerosol system is in the second configuration; and the accessory support bridge is broken by deliberate application of manual force to reconfigure the aerosol system from the third configuration to the first configuration.

* * * * *